US005114293A

United States Patent [19]

Rathert

[11] Patent Number: 5,114,293

[45] Date of Patent: May 19, 1992

[54] METHOD AND APPARATUS FOR ROUNDING THE BACKS OF BOOK BLOCKS

[75] Inventor: Horst Rathert, Minden, Fed. Rep. of Germany

[73] Assignee: Kolbus GmbH & Co. KG, Rahden, Fed. Rep. of Germany

[21] Appl. No.: 660,648

[22] Filed: Feb. 25, 1991

[30] Foreign Application Priority Data

Feb. 26, 1990 [DE] Fed. Rep. of Germany ..... 4005948

[51] Int. Cl.[5] ..... B42C 5/02

[52] U.S. Cl. ..... 412/30

[58] Field of Search ..... 412/9, 25, 30

[56] References Cited

U.S. PATENT DOCUMENTS

| | | | |
|---|---|---|---|
| 1,489,896 | 4/1924 | Murray | 412/30 |
| 1,959,656 | 5/1934 | Cahen | 412/30 |
| 2,010,810 | 8/1936 | Bredenberg | 412/30 |
| 3,199,129 | 8/1965 | Hawkes et al. | 412/30 |
| 3,358,798 | 7/1966 | Hawkes et al. | 412/30 |
| 3,413,669 | 12/1968 | Thorp | 412/30 |
| 4,747,740 | 5/1988 | Rahe | 412/30 X |

FOREIGN PATENT DOCUMENTS 1536507 1/1970 Fed. Rep. of Germany .

*Primary Examiner*—Paul A. Bell

*Attorney, Agent, or Firm*—Chilton, Alix & Van Kirk

[57] ABSTRACT

The rounding of the backs of book blocks in a bookbinding machine is accomplished through the use of rotatable rounding rollers which acquire the book blocks from continuously moving clamping devices of a block transport system, the rounding rollers moving in synchronism with the clamping devices along a portion of the path of book block motion defined by the transport system during the rounding operation. The rotational motion of the rounding rollers against the book block sides is superimposed on movement of the rounding rollers along the book block sides in a direction transverse to the path of motion thereof. Subsequent to completion of the rounding operation, the rounding rollers are returned to their initial position along return paths which are displaced from the book block motion path and the rounding operation is performed on a book block subsequently arriving via the transport system.

19 Claims, 4 Drawing Sheets

METHOD AND APPARATUS FOR ROUNDING THE BACKS OF BOOK BLOCKS

BACKGROUND OF THE INVENTION

1. Field of the Invention

The present invention relates to the manufacture of books and particularly to the rounding of the backs of book blocks as part of a bookbinding operation. More specifically, this invention is directed to book block back-rounding apparatus capable of high speed operation and especially to such apparatus wherein rounding rollers which act on the book block travel in synchronism with and cooperate with continuously movable book block clamps of a transport system which moves the blocks into and out of the back-rounding station. Accordingly, the general objects of the present invention are to provide novel and improved methods and apparatus of such character.

2. Description of the Prior Art

In the manufacture of books, and particularly in the binding of hard cover books, it is customary to perform a rounding operation on the book block. As a result of this rounding operation, the desired rounded shape is imparted to the block back and the trimmed block front. In the majority of book block processing machines presently employed, the rounding operation results from implementation of the well-known roller-rounding principle. During a roller-rounding operation, the individual leaves or printed sheets of a book block are smoothly and progressively displaced relative to each other as a result of the simultaneous engagement of the opposite sides of the book block by rotatably driven, grooved rounding rollers. The rotational force is applied to the book block sides concurrently with the application of pressure and is caused to occur through a defined rotation angle. Accordingly, as the book block passes through the rounding rollers, the leaves or printed sheets are pushed progressively further forwards as an inverse function of distance from the book block center.

For an example of prior art apparatus for rounding and simultaneously shaping book block backs, reference may be had to German Patent 1,536,507. This German patent discloses a bookbinding machine including a transport system which, in stepwise fashion, conveys book blocks longitudinally through a series of processing stations. The transport system comprises pairs of cooperating clamping jaws, the jaws of each pair facing one another across a variable gap. The cooperating clamping jaws engage the sides of a book block in order to convey it into the shaping station where it is engaged by the rounding rollers. In the shaping station, the book block enters the operating area of a pair of grooved rounding rollers which, once the clamping jaws have been retracted from the book block sides, act on the block to cause the shaping thereof in the manner briefly discussed above.

In order to permit operation of prior art book block rounding apparatus in an efficient manner, and particularly with an acceptably high through-put, various mechanical expedients have been attempted. Thus, for example, attempts have been made to increase efficiency by employing light-weight materials for a substantial percentage of the moving parts of the transport system to thereby increase operational speed and thus increase the linear speed at which the book blocks are conveyed from station-to-station. Nevertheless, considering the start-stop mode of operation of prior art apparatus such as that disclosed in the above-referenced German patent, prior art book block rounding apparatus can be utilized only within a limited range of outputs.

SUMMARY OF THE INVENTION

The present invention overcomes the above-briefly discussed and other deficiencies and disadvantages of the prior art and, in so doing, provides a novel and improved technique for rounding the backs of book blocks. This novel technique enables a substantial increase in operating speed in comparison to previously employed book block shaping techniques.

Apparatus in accordance with the present invention cooperates with a transport system having book block clamps which move continuously on an endless path, this path including the shaping station. The apparatus includes rotatable rounding rollers which are propelled, in synchronism with the book block clamps, along a segment of the path of block motion defined by the transport system. The rounding rollers are extended through apertures in the jaws of the book block clamps to engage opposite sides of a book block in order to perform the rounding operation. Thus, in counterdistinction to the prior art, the backs of the book blocks are shaped while moving with the clamps of the transport system which carry the book blocks from station to station.

The present invention is also characterized by movement of the rounding rollers in a first direction, corresponding to the direction of block transport, in a second direction transverse to the first direction, toward and away from the sides of a book block moving along the transport path, and in a third direction transverse to the first and second directions, after contact has been established between the rounding rollers and the opposite sides of the book lock being shaped. This movement in the third direction is superimposed on the rotational movement of the rounding rollers to compensate for the vertical movement of the book block which would otherwise result from the rotational movement. This compensation is for the purpose of keeping the outer leaves or printed sheets of the book block at a constant level and keeping the book block at a defined position relative to the transport system clamp, thereby facilitating the operations performed on the book block subsequent to shaping.

The present invention is easily implemented and thus permits back-rounding operations to be performed on plural book blocks simultaneously. Thus, in order to enhance operating speed, at least a second back-rounding apparatus of the type briefly described above may be incorporated into a single bookbinding machine.

BRIEF DESCRIPTION OF THE DRAWINGS

The present invention may be better understood and its numerous objects and advantages will become apparent to those skilled in the art by reference to the accompanying drawings wherein like reference numerals refer to like elements in the several figures and in which.

DESCRIPTION OF THE DISCLOSED EMBODIMENT

Figure 1:
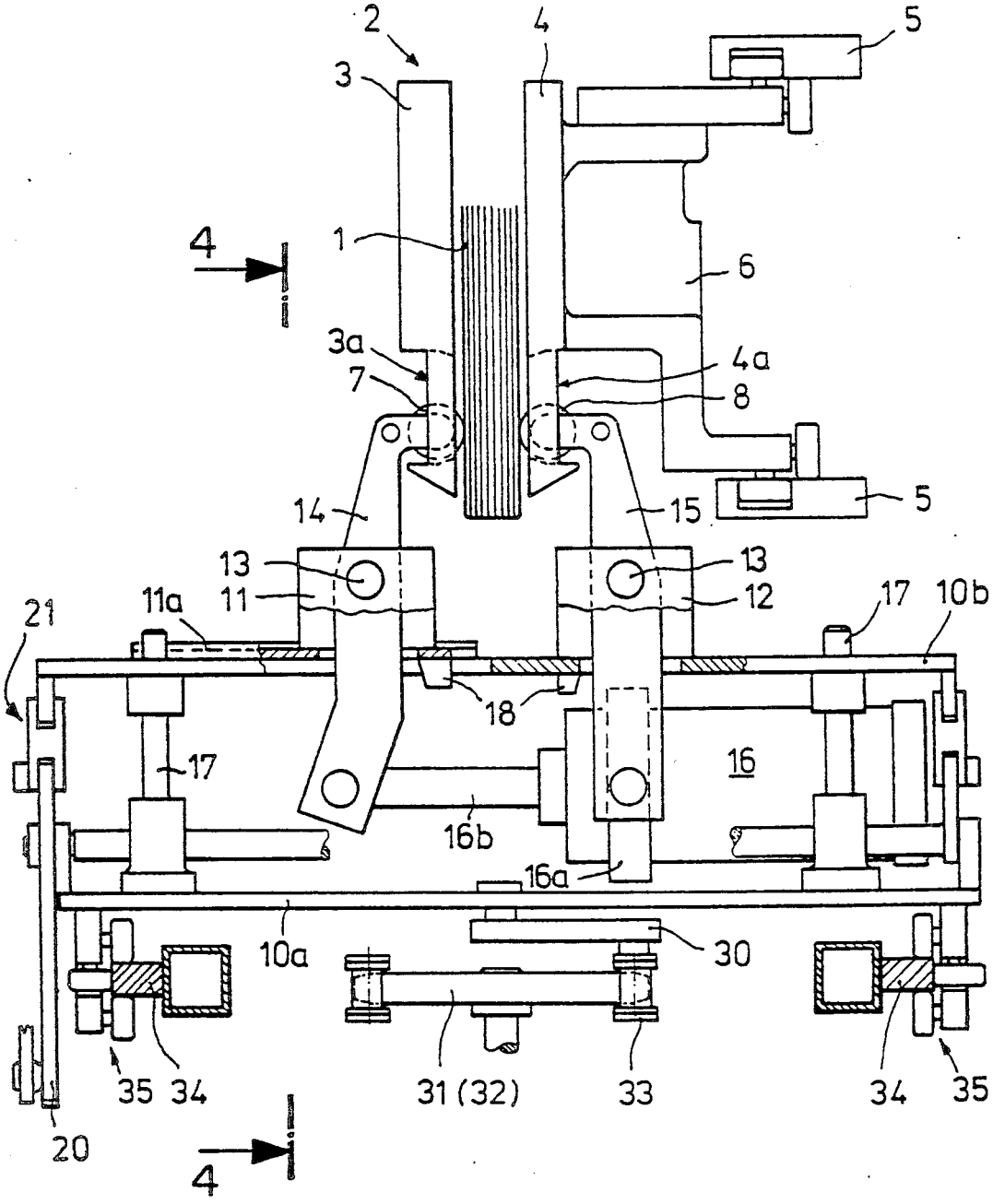
FIG. 1 is a schematic side elevation view, partly in section, of apparatus for rounding the backs of book blocks in a bookbinding machine in accordance with the present invention.

With reference now to the drawings, apparatus for shaping the backs of book blocks in accordance with a preferred embodiment of the invention is depicted schematically. A book block to be shaped is indicated at 1 and can best be seen from FIGS. 1 and 2. The disclosed apparatus includes a transport system, which is associated with a bookbinding machine, comprising a plurality of uniformly spaced book block clamps as indicated generally at 2. Each of the book block clamps 2 comprises a pair of clamping jaws 3 and 4 which face one another across a gap that can be varied. The jaws 3, 4 exert pressure on the opposite sides of a book block 1 in order to generate a force for holding the book block, with its back facing downwardly, as it is conveyed along a transport path of the bookbinding machine. The inner clamping jaw 4 of each clamp 2 is rigidly attached to a carrying frame 6 which, during movement, travels in a guide track 5 associated with a machine frame. The outer clamping jaw 3 can be displaced relative to the inner jaw 4 in the sense of a closing movement for picking up a book block 1 or an opening movement for releasing the book block. The opening and closing of the jaws of the clamps 2 is accomplished through the use of conventional actuating means, for example a contoured track, which has not been shown. The carrying frame 6 is coupled to a driven transport chain whereby the clamps, with the book blocks 1 held in a clamped condition, are caused to move continuously through the shaping station. The clamps 2 travel along an endless path, i.e., the transport chain will pass around reversing sprockets.

The apparatus for rounding the backs of the book blocks 1 is principally located below the transport system on a straight section of the path which the book blocks are caused to follow. As will be described in greater detail below, the book block shaping mechanism is moved along this straight path section, through a defined travel distance, in synchronism with the moving block clamps 2. After the shaping operation has been completed, the rounding apparatus is caused to reverse its direction of movement and return to its starting position.

Figure 2:
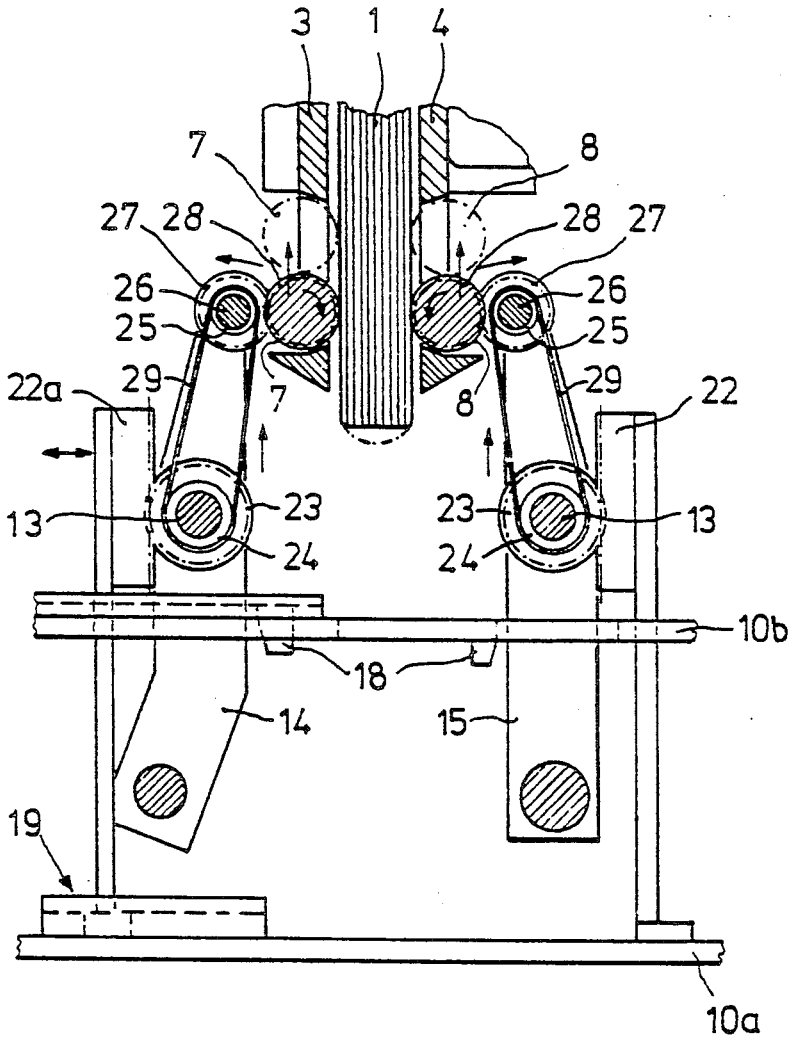
FIG. 2 is an enlarged view, taken along line 2—2 of FIG. 4, depicting the drive for the rounding rollers of the apparatus of FIG. 1.

It is well known that, during the roller-rounding of book block backs, individual leaves or printed sheets are smoothly and progressively displaced relative to each other as a result of the rolling movement of grooved rounding rollers, through a defined rotation angle, concurrently with the application of pressure. Accordingly, as the book block passes through the shaping station, the leaves or printed sheets are pushed progressively further, as indicated by the broken line showing in FIG. 2, as a function of spacing from the sides of the book block to impart the desired convex shape to the block back. In order to permit the rounding operation to be performed on a book block 1 which is positioned between the jaws of a moving clamp 2, in accordance with the present invention, the inner and outer clamping jaws 3, 4 are respectively provided with apertures 3*a*, 4*a*. The rounding rollers, which are indicated at 7 and 8 in FIGS. 1 and 2, are supported such that they can be moved inwardly and outwardly relative to the sides of a book block 1 during their movement along the path of travel of the book block in synchronism with the clamps 2. The movement of the rounding rollers in a direction transverse to the direction of block travel along the transport path is synchronized with the opening and closing movements of the clamping jaws 3, 4. Thus, the clamping jaws do not release the book block 1 until it has been acquired by the rounding rollers 7, 8. As soon as the book block 1 has been engaged by the oppositely disposed rounding rollers 7, 8, the rounding operation starts and, in the manner to be described below, the rotationally-driven rounding rollers 7, 8 execute their rolling movement on the sides of the book block.

As may best be seen from FIG. 2, the rounding rollers 7, 8 are caused to move in a third direction after their positioning inside the apertures 3*a*, 4*a* in the clamping jaws 3, 4. Thus, during the rotation thereof in the direction indicated by arrows, the rounding rollers 7, 8 are caused to move upwardly starting from a lower position, in which they are shown, to an upper position indicated by the dash-dot lines. This upward movement of the rotating rounding rollers 7, 8 compensates for the downwardly directed force resulting from the rotation of the rollers and causes the edges of the book block to remain at a constant level in the clamp 2 thus facilitating the subsequent formation of joint folds adjacent the edges. Once the rounding operation has been completed, the book block will be reacquired by the clamp 2 and the rounding rollers 7, 8 will swing away and subsequently return to their lower, starting position.

The apparatus for rounding the backs of the book blocks 1 is mounted on a movable frame 10. Frame 10 includes a base plate 10*a* having guide rods 17 extending vertically therefrom. A support plate 10*b* is mounted on guide rods 17 so as to be vertically movable. The frame 10, and thus the apparatus for rounding the backs of the book blocks 1, is propelled backwardly and forwardly along the block transport path by means of imparting motion to the frame 10.

Figure 4:
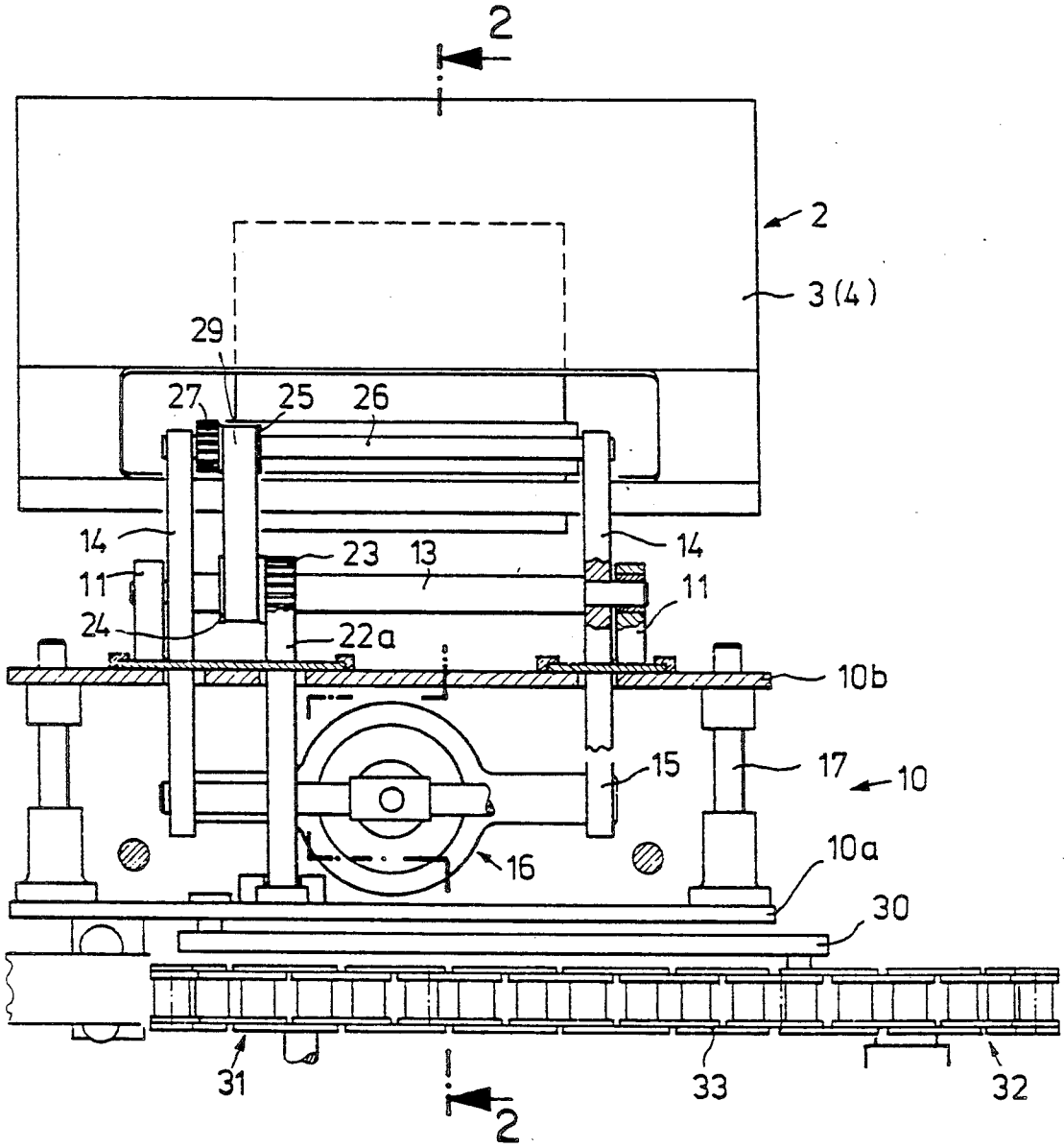
FIG. 4 is a cross-sectional front view taken along line 4—4 of FIG. 1.

Pairs of swinging levers 14, 15, which may best be seen by comparison of FIGS. 1 and 4, are mounted from support plate 10*b* in a directly opposed relationship via bearing shafts 13 which are received in bearing pedestals 11, 12. The rounding rollers 7, 8 respectively extend between the swinging levers of the lever pairs 14, 15. The rollers 7, 8 are mounted such that they can rotate freely relative to the swinging levers.

The swinging movement of the rounding rollers 7, 8, i.e., the backwards and forwards movement relative to the sides of a book block 1, is produced by a fluidic actuator 16 which is shown in FIG. 1. The piston rod 16*b* of actuator 16 is coupled to lever pair 14 while the actuator cylinder is, as indicated at 16*a*, coupled to the lever pair 15. Accordingly, as a result of admitting pressurized fluid to the cylinder of actuator 16, the piston rod 16*b* is extended thereby causing the pairs of swinging levers 14, 15 to rotate about their central pivot points, i.e., about the axes of shafts 13, thus reducing the spacing between the rounding rollers 7, 8 whereby these rollers will extend through the apertures in the clamping jaws and engage the sides of the book block. The opening of the rounding rollers occurs as a result of piston rod 16*b* being retracted, the retraction terminating when the levers 14, 15 contact mechanical stops 18.

Figure 3:
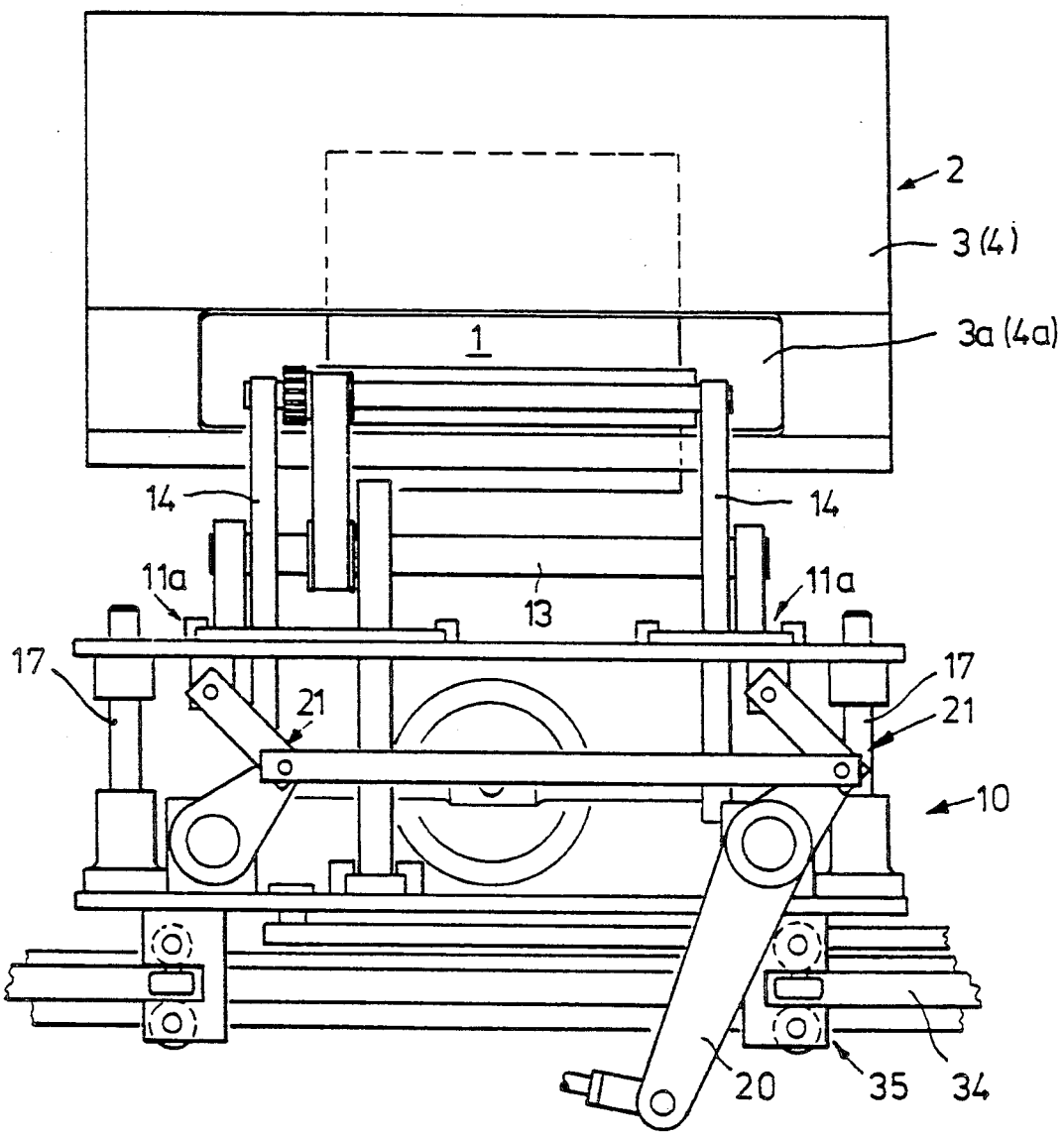
FIG. 3 is a partial front view of the apparatus of FIG. 1, FIG. 2 being a view taken from the right side as the apparatus is depicted in FIG. 1.

The lifting movement of the rounding rollers 7 and 8, i.e., the movement of the rollers in a direction transverse to the above-described opening and closing movement of lever pairs 14 and 15, occurs after the rounding rollers have been received in the apertures 3*a*, 4*a* in the clamping jaws 3, 4. This lifting movement also occurs in synchronism with the continuous movement, along the transport path, of the book block and, as will be explained below, simultaneously with the rotation of the rollers 7, 8. In the disclosed embodiment a common power source, which will not be described herein, provides the drive for imparting movement to the clamps 2 and for all of the motion imparted to the rounding rollers 7, 8 with the exception of the above-described inward-outward movement produced by actuator 16. The lifting movement of the rounding rollers, and thus also the rotational movement thereof in the disclosed embodiment, results from the raising of the support plate 10*b* through an arrangement of levers. Referring to FIGS. 1 and 3, these levers include an actuating lever 20 and intermediate parallel-lever arrangements 21 which are positioned at either side of the vertical plane which passes through the book block transport path. Each of the parallel-lever arrangements 21 acts on support plate 10*b* at two appropriately spaced points so as to cause plate 10*b* to move along guide rods 17 between lower and upper travel limits.

The lifting of the rounding rollers 7, 8 in response to the application of longitudinal force to the end of lever 20 is synchronized with the movement of the apparatus through a defined travel distance and causes, in the disclosed embodiment, the rollers to execute a predefined degree of rotational movement. To this end, pinions 23 are mounted on the bearing shafts 13 for the swinging levers 14, 15. These pinions engage stationary racks 22 and 23*a* mounted on frame 10. Thus, upward movement of support plate 10*b* causes rotation of the pinions 23 and this rotational movement is transmitted to the rollers 7, 8 via toothed drive belts 29. The belts 29 extend between a toothed wheel 24 on each of the shafts 13 and toothed wheels 25 which are mounted on intermediate shafts 26. The shafts 26 extend between the pairs of swinging levers 14, 15 and are supported in bearings. A gear wheel 27 is mounted on each of the shafts 26. Each gear wheel 27 meshes with a gear wheel 28 (FIG. 2) affixed to a rounding roller.

The rack 22, which in effect generates the rotational drive for rounding roller 8, is fastened to the base plate 10*a* and thus is fixed in position. The position of rack 22*a*, from which the rotational drive of the rounding roller 7 originates, can be altered on base plate 10*a* by means of a guide 19 (FIG. 2) which allows rack 22*a* to be moved toward or away from rack 22. Thus, the book shaping apparatus may be adjusted to accommodate different book block thicknesses. The adjustment of the spacing between racks 22 and 22*a* will be performed together with the repositioning of the pair of swinging levers 14 which carry rounding roller 7. The position of the swinging levers 14 is accomplished by adjusting the location of the bearing pedestals 11 on the supporting plate 10*b*. During the repositioning thereof, the bearing pedestals 11 travel in parallel guide ways which are indicated generally at 11*a* in FIG. 3, one of these guide ways also being shown in FIG. 1. The repositioning of the pedestals 11 will be accompanied by adjustment of the stroke of piston rod 16*b* of the actuator 16.

As noted above, the apparatus for rounding the backs of the book blocks 1 is movable along the book block movement path, in both forward and reverse directions, through a defined travel distance. The movement of the rounding rollers in the forward direction is, of course, in synchronism with the movement of the clamps 2 of the book block transport system. In order to guide the forward and backward movement of the shaping apparatus, vertical and horizontal running rollers 35 are provided on base plate 10*a*. These rollers engage, and thus travel on, tracks 34 which are supported on the machine frame. A propelling lever 30 is connected between base plate 10*a* and a drive chain 33 which runs around reversing sprockets 31, 32. Lever 30, as it travels with chain 33, thus moves base plate 10*a* backwardly and forwardly.

While a preferred embodiment has been shown and described, various modifications and substitutions may be made thereto without departing from the spirit and scope of the present invention. Thus, by way of example, alternate means to those described above may be employed for generating the rotational and vertical movements of the rounding rollers 7, 8. Also, as indicated above, block shaping apparatus in accordance with the present invention could be employed in tandem, for example, so as to perform back-rounding operations on plural book blocks simultaneously. Thus, it will be understood that the present invention has been described by way of illustration and not limitation.

What is claimed is:

1. In apparatus for shaping the backs of book blocks, the shaping apparatus being associated with a transport system including continuously moving clamps which engage and move a book block along a path, the shaping apparatus further having back-rounding means including rounding rollers which act on both sides of the book block once it has been released by a transport system clamp, the rounding rollers applying pressure to the book block and being caused to exert a rotational force on the block while the pressure is applied, the improvement comprising;

said clamps each comprising a pair of oppositely acting jaws, the clamp jaws each being provided with an aperture sized and shaped to permit the passage of a said rounding roller therethrough;

means for causing said shaping apparatus to move in a first direction in synchronism with the motion of said clamps along at least a portion of the path of book block movement established by the transport system; and means for imparting reciprocal motion to said rounding rollers in a second direction generally transverse to said first direction whereby said rounding rollers may be extended through said apertures in said jaws to engage the book block and may be retracted from said apertures.

2. The apparatus of claim 1 further comprising:

means for causing said rounding rollers to move in a third direction generally transverse to said first and second directions while said rollers are extended through said apertures in said jaws.

3. The apparatus of claim 2 wherein said movement in said third direction is superimposed on the rotational movement of said rounding rollers.

4. The apparatus of claim 2 further comprising:

means responsive to said movement of said rounding rollers in said third direction for causing rotation of said rollers, said motion in said third direction thereby being superimposed on said rotational movement.

5. The apparatus of claim 4 wherein said means responsive to movement of said rounding rollers in said third direction for causing rotation thereof comprises:

stationary gear means; and first drive means on each of said lever means, said first drive means cooperating with respective of said stationary gear means for translating said movement of said lever means in said third direction into rotational movement of said rounding rollers.

6. The apparatus of claim 1 wherein said means for imparting reciprocal motion to said rounding rollers comprises:

a pair of oppositely disposed lever means, said rounding rollers being supported from respective of said lever means;

support plate means;

means for pivotally mounting said lever means from said support plate means; and actuator means coupled to said lever means for causing the individual of said lever means to simultaneously pivot in opposite directions.

7. The apparatus of claim 6 wherein the spacing between said lever means mounting means is adjustable.

8. The apparatus of claim 6 further comprising:

means for causing said rounding rollers to move in a third direction generally transverse to said first and second directions while said rollers are extended through said apertures in said jaws.

9. The apparatus of claim 8 further comprising:

means responsive to said movement of said rounding rollers in said third direction for causing rotation of said rollers, said motion in said third direction thereby being superimposed on said rotational movement.

10. The apparatus of claim 9 further comprising base frame means, said support plate means being movably mounted on said base frame means, and wherein said means responsive to movement of said rounding rollers in said third direction for causing rotation thereof comprises:

a pair of stationary gear means mounted on said base frame means; and first drive means on each of said lever means, said first drive means cooperating with respective of said stationary gear means for translating said movement of said lever means in said third direction into rotational movement of said rounding rollers.

11. The apparatus of claim 10 wherein the spacing between said lever means mounting means is adjustable.

12. The apparatus of claim 8 further comprising:

base means, said base means defining a plane; and wherein said means for causing motion of said rounding rollers in a third direction comprises:

means mounting said support plate means from said base means, said mounting means permitting movement of said support plate means in said third direction, said third direction being transverse to said plane; and means for causing relative motion in said third direction between said base means and said support plate.

13. The apparatus of claim 12 wherein said means for causing said shaping apparatus to move in said first direction comprises drive means engaging said base means, said drive means defining a path of base means motion whereby said base means will return to an initial position along said path at the conclusion of the shaping operation.

14. The apparatus of claim 12 further comprising:

means responsive to said movement of said rounding rollers in said third direction for causing rotation of said rollers, said motion in said third direction thereby being superimposed on said rotational movement.

15. The apparatus of claim 14 wherein said means responsive to movement of said rounding rollers in said third direction for causing rotation thereof comprises:

a pair of stationary gear means mounted on said base means; and first drive means on each of said lever means, said first drive means cooperating with respective of said stationary gear means for translating movement of said support plate means relative to said base means in said third direction into rotational movement of said rounding rollers.

16. The apparatus of claim 14 wherein said means for causing said shaping apparatus to move in said first direction comprises drive means engaging said base means, said drive means defining a path of base means motion whereby said base means will return to an initial position along said path at the conclusion of the shaping operation.

17. The apparatus of claim 16 further comprising:

means responsive to said movement of said rounding rollers in said third direction for causing rotation of said rollers, said motion in said third direction thereby being superimposed on said rotational movement.

18. The apparatus of claim 17 wherein said means responsive to movement of said rounding rollers in said third direction for causing rotation thereof comprises:

a pair of stationary gear means mounted on said base means; and first drive means on each of said lever means, said first drive means cooperating with respective of said stationary gear means for translating movement of said support plate means relative to said base means in said third direction into rotational movement of said rounding rollers.

19. The apparatus of claim 18 wherein the spacing between said lever means mounting means is adjustable.

* * * * *